United States Patent [19]

Haub

[11] Patent Number: 4,805,905

[45] Date of Patent: Feb. 21, 1989

[54] BASKETBALL PLAYER'S TRAINING AID FOR TEACHING PROPER FOLLOW THROUGH

[76] Inventor: Gary Haub, P.O. Box 335, Corydon, Ind. 47112

[21] Appl. No.: 104,120

[22] Filed: Oct. 5, 1987

[51] Int. Cl.[4] ..... A63B 69/00

[52] U.S. Cl. ..... 273/1.5 A

[58] Field of Search ..... 273/1.5 A, 54 B, 54 BA; 272/67

[56] References Cited

U.S. PATENT DOCUMENTS

| | | | |
|---|---|---|---|
| 867,981 | 10/1907 | Krizek | 272/67 |
| 2,994,533 | 8/1961 | Pupilla, Jr. | 273/54 BA |
| 3,726,525 | 4/1973 | Jackson | 273/54 B |
| 4,039,183 | 8/1977 | Sakurada | 272/67 |
| 4,441,711 | 4/1984 | Dubar et al. | 273/54 B |

OTHER PUBLICATIONS

Indian Head Recreation Products Catalog #971, rec'd 2/25/72, "Passback".

*Primary Examiner*—Paul E. Shapiro

*Attorney, Agent, or Firm*—Maurice L. Miller, Jr.

[57] ABSTRACT

A flexible, adjustable wrist bank which is snuggly and non-slippably worn on the shooting arm of a basketball player near the wrist is disclosed, which includes an elongated flexible, plastic tube connected at one end thereof to the band and at its outer end to a feeler device. The feeler device may be a transversely extending plastic tube joined at mid-length to the elongated tube. The elongated tube contains a wire extending there through to give it rigidity so that it will hold its shape once determined, yet allow the shape of the tube, such as the curvature thereof, to be changed for use by different players having different hand sizes and finger lengths. A washer is confined in a pocket in the wrist band against which the elongated tube connects to provide a broadened, rigid supporting surface for the elongated tube to help prevent it from flopping and wobbling at the point of its connection to the band.

15 Claims, 2 Drawing Sheets

BASKETBALL PLAYER'S TRAINING AID FOR TEACHING PROPER FOLLOW THROUGH

BACKGROUND OF THE INVENTION

This invention relates generally to athletic training aids and, more specifically, to a wrist band device worn by a basketball player on his or her shooting arm during practice sessions to indicate proper follow through of the wrist, hand and fingers of the shooting hand upon release of a basketball during the course of taking a set shot, jump shot or free throw.

Generally speaking, several devices for training proper basketball shooting technique to improve shooting accuracy are known in the prior art. See, for example, U.S. Pat. No. 3,820,783 issued to G. W. Caveness on June 28, 1974, which discloses a transversely extending gauge bar connected to a belt or harness which indicates the height to which a shooter's elbow should be raised before extending the forearm to shoot a basketball. See also U.S. Pat. No. 4,377,284, issued to John Oberlin on Mar. 22, 1983, which illustrates a pair of sleeves, which fit snugly over the forearms near the elbows, which are interconnected with a stretchable, flexible band, tending to hold the shooter's elbows in close proximity when making practice shots. U.S. Pat. No. 4,383,685 issued to L. E. Bishop on May 17, 1983, shows a basketball shooter's training aid consisting of a vest worn by a player, a curved guide bar pivotally mounted on the vest, an elastic elbow sleeve worn on the player's shooting arm and slidably attached to the curved guide bar, and a bracing assembly connected between the guide bar and the vest to maintain proper alignment of the bar. Lastly, see U.S. Pat. No. 4,579,341, issued to G. H. Furr on Apr. 1, 1986, which discloses a basketball player's shooting guide. The guide includes a body harness to the back of which is attached a forwardly projecting L-shaped arm guide rod, which extends across the outside of the player's shooting arm and tends to control his upper arm so that his elbow will move in a vertical plane and remain under the ball during the course of a shot.

None of these prior art devices deal with the major problem of proper follow through of the wrist, hand and fingers of the shooting arm following release of the basketball during the course of taking a set shot, jump shot or free throw. Smooth, continuous and complete follow through movement of the hand, wrist and fingers of the shooting arm as opposed to sudden, stopping of the movement of the hand, wrist and fingers upon release of the ball has to come to be regarded as extremely important in relation to shooting accuracy and effective shooting range.

By means of my invention, a training aid is now provided, which addresses the important problem of proper follow through of the shooting hand, wrist and fingers.

SUMMARY OF THE INVENTION

It is an object of my invention to provide a training aid for teaching proper follow through of the shooting hand of a basketball player during and immediately following lofting and release of a basketball in the course of shooting the basketball at a goal.

It is a further object of my invention to provide an adjustable training aid for teaching proper follow through as aforesaid, which is adjustable for use by basketball players having different hand sizes and wrist circumferences.

It is another object of my invention to provide a training aid for a basketball shooter wherein the shooter can, by contact of the fingers of his or her shooting hand, immediately ascertain that he or she executed the proper follow through motion of his or her wrist and fingers of the shooting hand.

Briefly in accordance with my invention, I provide a training aid for use by a basketball player in executing proper shooting technique. The training aid includes a flexible wrist band securely and non-slippably connectable about a forearm of a basketball player's shooting arm near the wrist. The training aid also includes feeler means projecting from and connected to the wrist band for permitting fingers of the player's shooting hand to contact a portion thereof upon proper follow through motion of the player's shooting hand and fingers following release of a basketball during the course of shooting a basketball.

These and other objects, features and advantages of my invention will become apparent to those skilled in the art from a study of the following detailed description and attached drawings upon which, by way of example, only one preferred embodiment of my invention is described and illustrated.

DESCRIPTION OF THE PREFERRED EMBODIMENT

Figure 1:
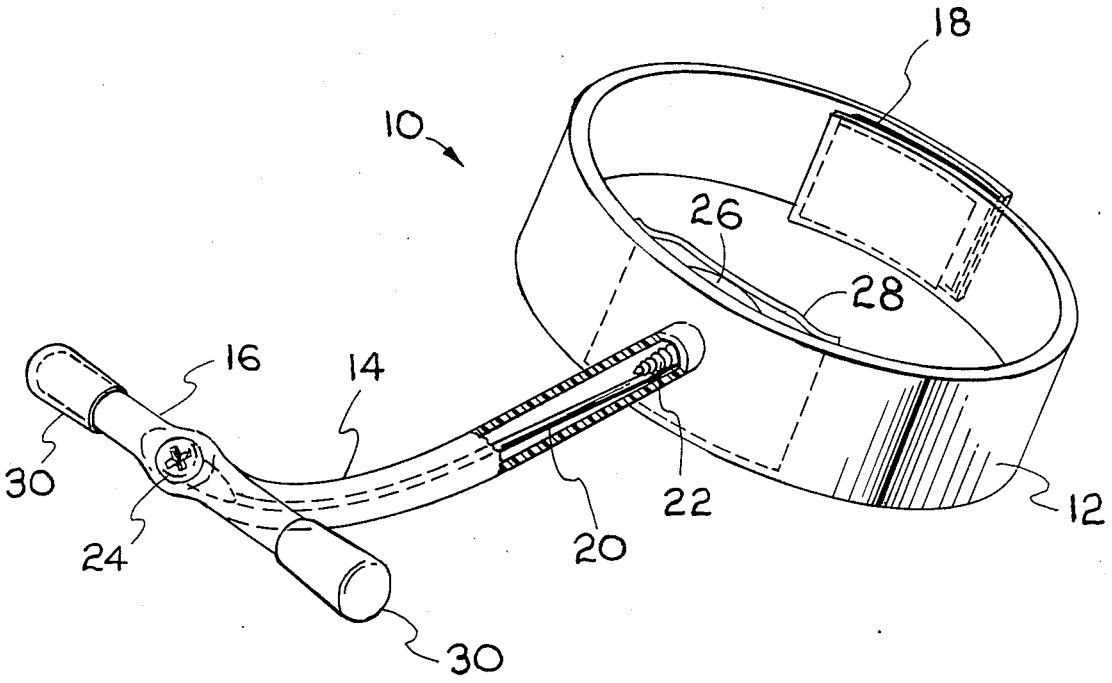
FIG. 1 shows an oblique projection of a basketball shooter's training aid, thus illustrating one preferred embodiment of my invention.

Referring now to the drawing figures there is shown, in one preferred embodiment of my invention, a basketball shooter's training aid 10 which includes a flexible, adjustable wrist band 12, a semi-rigid, adjustable, elongated tube 14 connected at one end to the band 12, and a feeler element 16 connected on a mid-portion thereof to the other end of the tube 14.

The wrist band 12 may be constructed by any suitable and durable cloth or fabric. Overlapping portions of the bands 12 of the present example of the invention contain a pair of opposing and interlocking hook and loop pile strips 18 of lengths sufficient to permit adjustment of the circumference of the band 12 to fit wrists of different sizes. The wrist band 12 should be adapted to fit sufficiently tight so that there will be no slippage thereof along the wrist or forearm of the wearer whose arms are likely to undergo considerable jerking and swinging motions, due to the game of basketball. The hook and loop pile strips 18 should be of the type which are sewn onto the band 12 rather than the adhesive backed type which are glued to the fabric since the latter type may tend to become unglued, due to severe flexing of the band 12 and/or the influence of perspiration. In the alternative, a conventional wrist band buckle or other suitably adjustable fastening means may be used in place of the strips 18.

The tube 14 may be of any suitable material such as black, colored, or clear plastic or rubber that is flexible so that it can be adjusted, as later more fully explained, yet be rigidifiable so as to hold its desired form and shape under the stresses normally encountered in dribbling and shooting a basketball. To accomplish the foregoing, I recommend using a ¼-inch thick polyurethane hollow plastic tube about 5¾ inches in length through the hollow shaft of which extends a steel wire 20 of suitable gauge and rigidity. I prefer using #14 gauge steel wire, although a steel wire 20 of from 12 to 16 gauge should work satisfactorily to stiffen and rigidify the tube 14 to hold its desired shape and form, yet permit adjustment of its shape and form to meet the needs of different wearers. The wire 20 extends substantially the entire length of the tube 14 and projects tightly between the screws 22 and 24 in opposite ends of the tube 14 and the adjacent inside surface of the tube walls.

Figure 2:
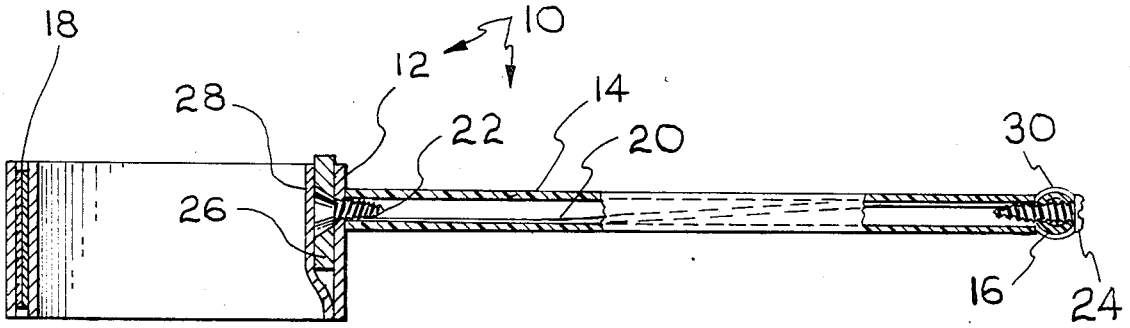
FIG. 2 shows a side elevation view of the training aid of FIG. 1 with portions torn away for clarity.

The screw 22, which may be a round head, ¾-inch particle board type screw, is inserted through a hard rubber washer 26, such as a plumber's faucet washer, thence then through a hole in the band 12 into the tube 14. The corresponding end of the tube 14 fits flush against the exterior surface of the fabric of the band 12 around the hole through which the screw 22 projects as best seen in FIG. 2. A strip of the same type of fabric of which the band 12 is made forms a backing 28 for the screw 22 and washer 26. The washer 26 forms a rigid brace or surface of support for the tube 14 so as to eliminate twisting or floppiness of the latter where it connects to the flexible cloth band 12.

The feeler element 16 may also be a colored, black or clear ¼-inch thick hollow tube of polyurethane or other suitable plastic or rubber which I prefer to make 2 inches in length. The open end portions of the tube element 16 may be covered with polyurethane end caps 30 having smoothly rounded ends so as to shield the relatively sharp edges of the ends of the elements 16 and to prevent clogging the open ends of such elements with dirt, dust or the like.

Figure 4:
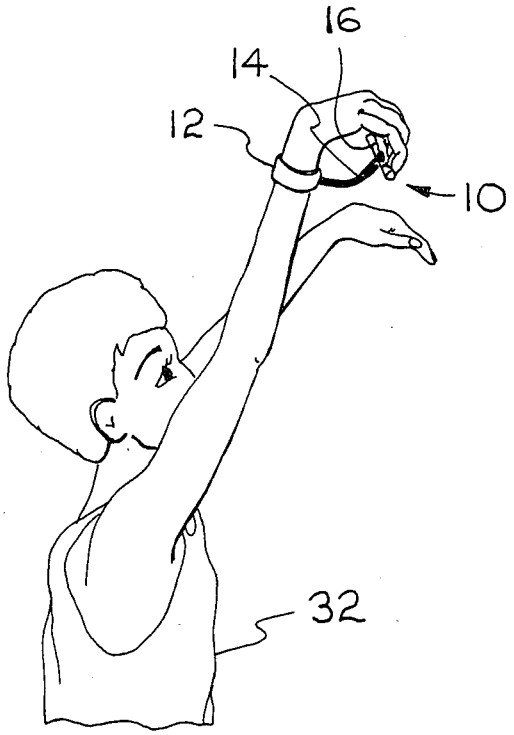
FIG. 3–4 show the use of the training aid of FIGS. 1–2 on the wrist area of the shooting hand of a basketball player during and immediately following a shot.
Figure 3:
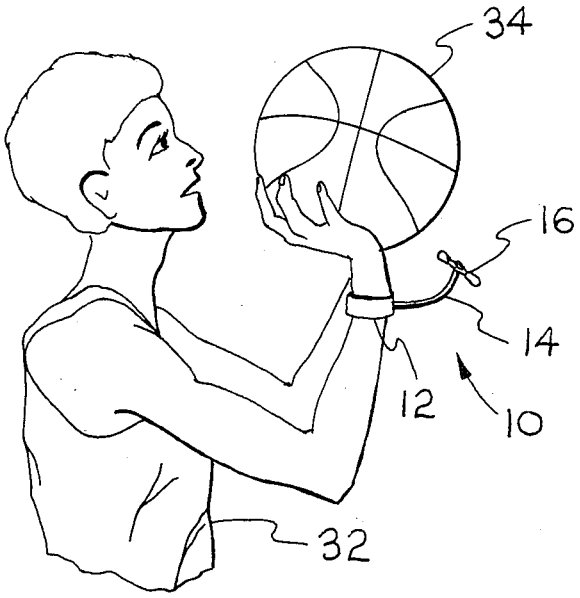

As shown in FIGS. 3–4, a basketball player 32 fastens the wrist band 12 of the training aid about the forearm of his shooting hand near the wrist as one would fasten a watch band, for example. Thereafter, he adjusts the tube 14 in an arc so that the feeler element 16 will just be touched at about the outer joints of middle and fourth fingers of the hand upon proper follow through of the shooting hand after a basketball 34 is shot, as by flicking the wrist and fingers of the upstretched arm and hand downwardly upon release of the ball (see FIG. 4). Upon proper adjustment of the tube 14 as just described, the shooter's middle and forth fingers should always gently come into contact with the feeler element 16 upon release of the ball 34 in an arching long shot so long as the hand executes proper full and complete follow-through. If the shooter does not feel at least his middle finger coming into contact against the element 16 upon release of the ball, he immediately realizes that he has improperly jerked his hand to a sudden stop, rather than having executed the proper follow through movement of the hand in the desired smooth and continuous manner. As noted in FIG. 3, the feeler element 16, when properly adjusted, does not interfere with sighting, alignment of the shooting hand and arm, or lofting of the ball 34.

I believe that proper and repeated use of the practice aid of my invention in connection with set shooting and jump-shooting practice can produce numerous desired results, namely, higher follow through and greater extension of the shooting arm, more complete follow through of the shooting hand and corresponding wrist and fingers, increased back spin on the ball and increased arch and more accurate direction of flight of the ball. As a result, a shooter who practices regularly and properly with the training aid of the present invention can develop a more accurate set shot and jump shot, extend his or her effective shooting range, develop more consistency in shooting, and improve his or her free-throw shooting percentage.

Although the present invention has been described with respect to specific details of one preferred embodiment thereof, it is not intended that such details limit the scope and coverage of this patent otherwise than as expressly set forth in the following claims.

I claim:

1. A training said for use by a basketball player in executing proper shooting technique comprising:

a flexible wrist band securely and non-slippably connectable about the forearm of a basketball player's shooting arm near the wrist;

feeler means constructed of a flexible material projecting from and connected to said wrist band for permitting fingers of said player's shooting hand to contact a portion thereof only upon proper downward follow through motion of said player's shooting hand following release of a basketball in the course of shooting the same, and means associated with said feeler means for rigidifying the latter such that the shape of said feeler means can be changed to change the downward and inward follow through distance that the fingers of a player's shooting hand must travel in order to touch said feeler means to accommodate different players having varying hand sizes.

2. The training aid of claim 1 wherein said wrist band is made of cloth.

3. The training aid of claim 1 wherein said wrist band is adjustable.

4. The training aid of claim 1 further comprising a pair of opposing hook and loop pile strips connected to facing surfaces of overlapping end portions of said wrist band for rendering the circumference of said wrist band adjustable.

5. The training said of claim 1 wherein said feeler means comprises an elongated, flexible tube connected on one end portion thereof to said wrist band, said training aid further including a feeler element connected to the other end of said tube for touching by fingers on the shooting hand of a basketball shooter upon proper shooting hand follow through in the course of shooting a basketball.

6. The training aid of claim 5 wherein said means associated with said feeler means comprises a wire or cable extending through substantially the entire length of said tube having an amount of rigidity in excess of the rigidity of said tube.

7. The training aid of claim 5 wherein said feeler element is a tube connected at about the mid-point in its length to said other end of said flexible tube.

8. The training aid of claim 7 further comprising a pair of end caps covering the ends of said feeler element tube.

9. The wrist band of claim 7 wherein said feeler element tube is connected to said flexible tube by means of a threaded fastener extending diametrically through said feeler element tube and into the adjoining end of the flexible tube.

10. The training aid of claim 5 wherein said tube is constructed of plastic.

11. The training aid of claim 10 wherein said tube is about $5\frac{3}{4}$ inches in length and said feeler element is about 2 inches in length.

12. The training aid of claim 5 wherein said feeler element is constructed of plastic.

13. The training aid of claim 5 further comprising means for bracing said elongated tube in the region of its connections to said wrist band to reduce twisting and floppiness of said tube at its connection to said wrist band.

14. The training aid of claim 13 wherein said bracing means comprises a washer connected to an inside surface of said wrist band, said one end of said flexible tube being connected through said wrist band to said washer.

15. The training aid of claim 14 wherein said washer is joined to an end of said flexible tube by a threaded fastener.

* * * * *